US005470076A

United States Patent [19]

Cadorniga

[11] Patent Number: 5,470,076

[45] Date of Patent: Nov. 28, 1995

[54] GOLF BALL

[75] Inventor: Lauro C. Cadorniga, Piedmont, S.C.

[73] Assignee: Dunlop Slazenger Corporation, Greenville, S.C.

[21] Appl. No.: 18,744

[22] Filed: Feb. 17, 1993

[51] Int. Cl.[6] ..... A63B 37/14

[52] U.S. Cl. ..... 273/232

[58] Field of Search ..... 273/232; D21/205

[56] References Cited

U.S. PATENT DOCUMENTS

| | | | |
|---|---|---|---|
| 878,254 | 2/1908 | Taylor | 273/232 |
| 1,418,220 | 5/1922 | White | 273/232 |
| 4,681,323 | 7/1987 | Alaki | 273/232 |
| 4,787,638 | 11/1988 | Kobayashi | 273/232 |
| 4,830,378 | 5/1989 | Aoyama | 273/232 |
| 4,840,381 | 6/1989 | Ihara | 273/232 |
| 4,877,252 | 11/1989 | Shaw | 273/232 |
| 4,979,747 | 12/1990 | Jonkouski | 273/232 |
| 5,338,039 | 8/1994 | Oka et al. | 273/232 |

FOREIGN PATENT DOCUMENTS

| | | | |
|---|---|---|---|
| 962046 | 5/1932 | Canada | 273/232 |
| 967188 | 5/1975 | Canada . | |
| 171528 | 11/1921 | United Kingdom | 273/232 |
| 2215621 | 9/1989 | United Kingdom | 273/232 |

*Primary Examiner*—George J. Marlo
*Attorney, Agent, or Firm*—Lorusso & Loud

[57] ABSTRACT

A golf ball having a plurality of dimples therein, each of the dimples including a major dimple portion comprising a first recess formed in the surface of the ball, the major dimple portion having a span from side to side, a side wall and a bottom wall, and a minor dimple portion comprising a second recess formed in the bottom wall of the major dimple portion, the minor dimple portion having a span from side to side, parallel to the major dimple portion span, and smaller than the major dimple portion span, a side wall and a bottom wall, the major and minor dimple portions being of similar configuration, with the minor dimple portion being substantially centered in the major dimple portion and interrupting the major dimple portion bottom wall.

11 Claims, 3 Drawing Sheets

GOLF BALL

BACKGROUND OF THE INVENTION

1. Field of the Invention

This invention relates to golf balls and is directed more particularly to a golf ball having a unique dimple configuration.

2. Description of the Prior Art

It has long been known to be advantageous to provide a golf ball with cavities, or dimples, circular in planform and more or less evenly distributed over the surface of the ball. U.S. Pat. No. 878,254, issued Feb. 4, 1908 to William Taylor is illustrative of an early embodiment of such a golf ball.

Efforts have been made since the introduction of the dimpled ball to improve the flight characteristics of the ball by improving the pattern of dimples in the surface of the ball, and improving the configuration of each individual dimple. U.S. Pat. No. 4,142,727, issued Mar. 6, 1979 to Michael Shaw and Robert C. Haines is illustrative of the quest for an optimal pattern of dimples. U.S. Pat. No. 4,090,716, issued May 23, 1978 to Frank S. Martin et al, is illustrative of the effort to maximize the dimple configuration, featuring dimples in the shape of inverted pyramids with hexagonal bases. U.S. Pat. No. 4,681,323, issued Jul. 21, 1987 to Yasuhide Alaki, et al, shows and describes a number of dimple shapes which are circular in planform and of varying configurations in centerline section.

While improvements in performance have been realized by the above-mentioned innovations, there is continuously a demand for still further improvements in golf ball performance, particularly with respect to improvements in distance and accuracy.

SUMMARY OF THE INVENTION

It is, therefore, an object of the invention to provide a golf ball having a plurality of dimples therein, the dimples being of such configuration as to provide improved range and accuracy.

With the above and other objects in view, as will hereinafter appear, a feature of the present invention is the provision of a golf ball having a plurality of dimples therein, each of the dimples comprising a major dimple portion comprising a first recess formed in a surface of the ball, the major dimple portion having a largest span from side edge to side edge, side wall means and bottom wall means, and a minor dimple portion comprising a second recess formed in the bottom wall means of the major dimple portion, the minor dimple portion having a largest span from side edge to side edge, parallel to the major dimple largest span, and smaller than the major dimple span, side wall means and bottom wall means, the major and minor dimple portions being of similar configurations, with the minor dimple portion being substantially centered in the major dimple portion and interrupting the major dimple bottom wall means.

The above and other features of the invention, including various novel details of construction and combinations of parts, will now be more particularly described with reference to the accompanying drawings and pointed out in the claims. It will be understood that the particular ball and dimples embodying the invention are shown by way of illustration only and not as limitations of the invention. The principles and features of this invention may be employed in various and numerous embodiments without departing from the scope of the invention.

BRIEF DESCRIPTION OF THE DRAWINGS

Reference is made to the accompanying drawings in which is shown an illustrative embodiment of the invention, from which its novel features and advantages will be apparent.

In the drawings.

DESCRIPTION OF THE PREFERRED EMBODIMENT

Figure 1:
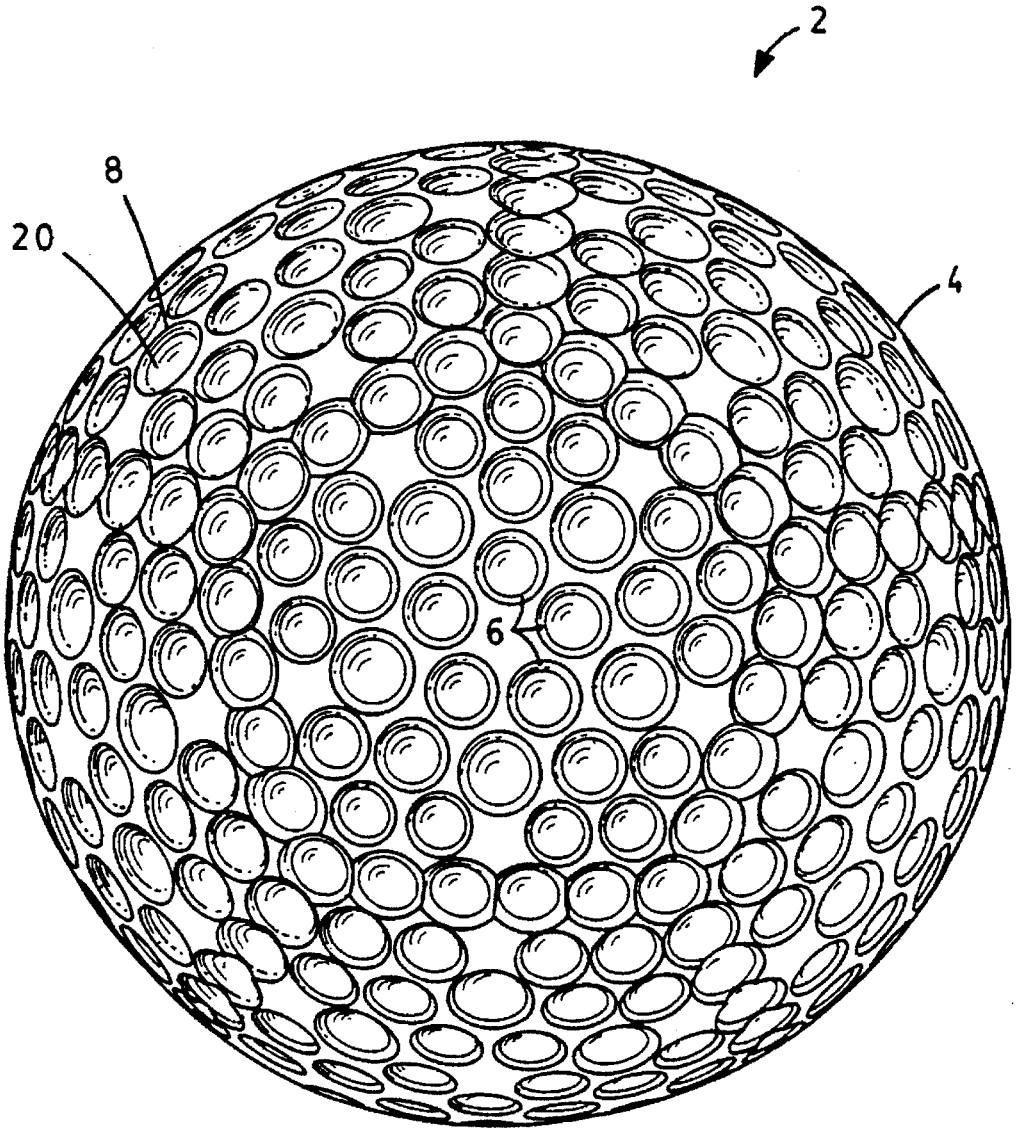
FIG. 1 is a top plan view of one form of ball with dimples illustrative of an embodiment of the invention.

Referring to FIG. 1 of the drawings, it will be seen that the illustrative golf ball 2 is provided with a spherical surface 4 in which are disposed a plurality of dimples 6. The dimples may be disposed in any of several available patterns known in the art.

Figure 2:
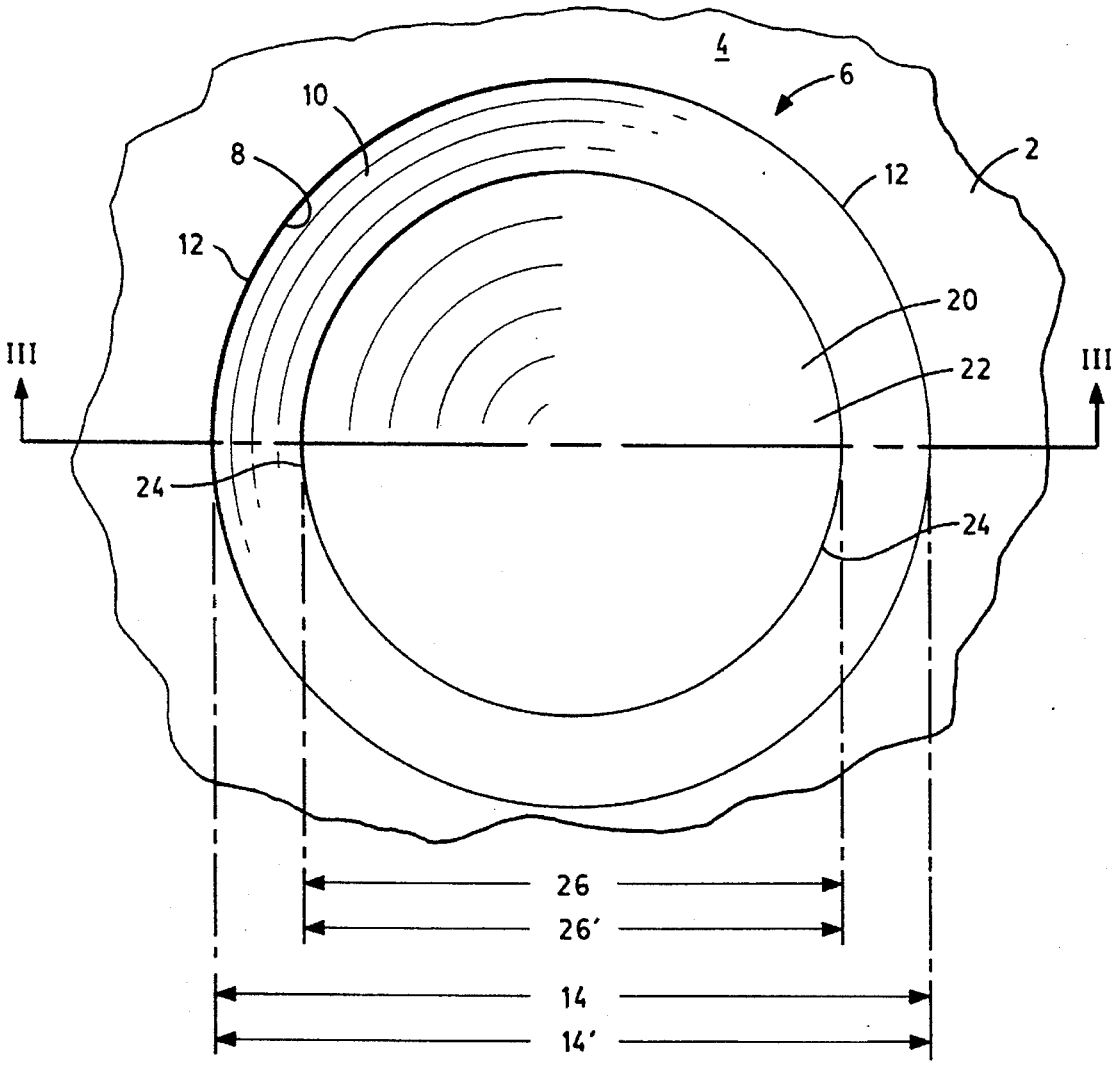
FIG. 2 is a top planform view of a single dimple of the configuration shown in FIG. 1.
Figure 3:
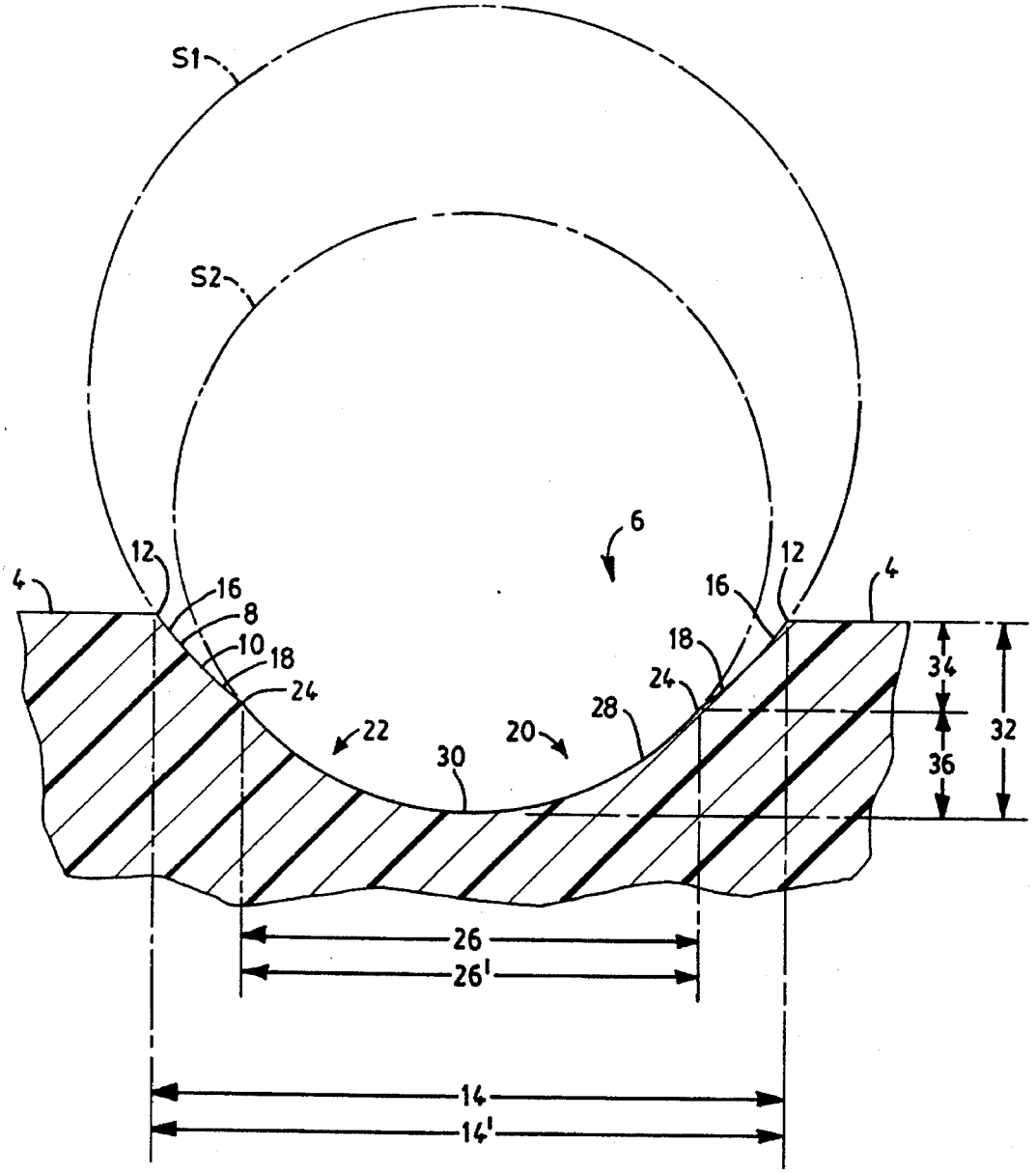
FIG. 3 is a sectional view, taken along line III—III of FIG. 2.

Referring to FIGS. 2 and 3, it will be seen that each individual dimple includes a major dimple portion 8 comprising a first recess 10 formed in the surface 4 of the ball 2 and having an edge 12 defining the periphery of the dimple. The major dimple portion 8 has a largest span 14 which extends from side edge to side edge 12. The major dimple portion 8 is provided with a side wall 16 and a bottom wall 18.

Each dimple 6 further is provided with a minor dimple portion 20 which comprises a second recess 22 formed in the major dimple portion bottom wall 18 and having an edge 24 defining the periphery of the minor dimple portion. The minor dimple portion 20 has a largest span 26 from side edge to side edge 24, parallel to and smaller than the major dimple portion span 14. The minor dimple portion 20 is provided with a side wall 28 and a bottom wall 30.

The major dimple portions 8 may be of any geometrical configuration, and, in accordance with the invention, the minor dimple portion 20 is of a configuration similar to that of the major dimple portion 8 and similarly oriented, such that the largest side-to-side spans, 14 and 26, of the two dimple portions, 8 and 20, are parallel and extend between similar points in the geometrical configuration chosen for the major and minor dimple portions.

Regardless of the configuration selected, it is preferred that the largest span 14 of the major dimple portion 8 be 0.10–0.18 inch, and the corresponding span 26 of the minor dimple portion 20, be 25%–75% of the length of the major dimple portion span 14. It still further is preferred that the relationship between the two spans, 14 and 26, be constant for all the dimples 6 of the double recess configuration in the ball 2.

In a preferred configuration of dimple, the major and minor dimple portions 8, 20 are of a semi-spherical configuration. That is, the recesses 10, 22 are formed complementary to portions of first and second spheres, 51 and 52, of unequal size, such that the second, or minor recess 22 forms the minor dimple portion 20 in the bottom wall 18 of the first, or major recess 10.

When the dimple portions 8, 20 are of spherical configuration, the edges 12, 24, respectively, thereof are circular in planform and the spans 14, 26 extending from edge to edge across the recesses 10, 22 comprise, respectively, major and minor chords 14', 26'.

As in the case of non-spherical recesses, it is preferable that the major chord 14' be 0.10–0.18 inch, and that the minor chord be 25%–75% of the length of the major chord. An exemplary preferred embodiment is provided with a major chord of about 0.130 inch and a minor chord of about 0.075 inch, with the minor dimple portion 20 disposed concentrically within the major dimple portion 8.

As may be seen in FIG. 3, the major chord 14' is measured tangent to the spherical ball surface 4 on opposite side edges 12 of the dimple 6. Similarly, the minor chord 26' is determined by the straight line distance side-to-side between the edges 24 of the minor dimple, formed by the intersection of the minor dimple and the major dimple. Total depth 32 of the dimple 6 is measured between the major chord 14' and the bottom 30 of the minor dimple portion 20 at its center. The depth 34 of the major dimple portion 8 is the vertical distance between the major and minor chords 14', 26'. The depth 36 of the minor dimple portion 20 is the vertical distance between the minor chord 26' and the bottom 30 of the minor dimple portion at its center.

In a preferred embodiment, the ratio of minor dimple portion depth to major dimple portion depth, that is 36/34, is constant for all the dimples 6 of the double recess configuration in the ball 2.

In another exemplary preferred embodiment, the ball 2 is provided with 432 dimples, all of the double recess configuration described herein. The dimples are arranged in an icosahedral lattice, known in the art. There are four sizes of dimples utilized in the ball. The largest dimples are provided with a major chord 14' of about 0.163 inch and a minor chord 26' of about 0.057 inch. The major dimple portion depth 34 of the largest dimples is about 0.0050 inch and the minor dimple portion depth 36 is about 0.0020 inch. The second largest dimples are provided with a major chord 14' of 0.140 inch and a minor chord 26' of 0.049 inch. The major depth 34 of the second largest dimples is about 0.0045 inch and the minor depth 36 is about 0.0018 inch. The third largest dimples are provided with a major chord 14' of 0.135 inches and a minor chord 26' of 0.047 inch. The major depth 34 of the third largest dimples is about 0.0045 inch, and the minor depth 36 is about 0.0018 inch. And the smallest dimples are provided with a major chord 14' of 0.107 inch and a minor chord 26' of 0.038 inch. The major depth 34 of the smallest dimples is 0.0035 inch, and the minor depth 36 is about 0.0014 inch. Thus, in each instance the ratio of the minor chord to the major chord is substantially a constant, 0.35, and the ratio of the minor depth to the major depth is substantially a constant, 0.40.

Dimple dimensions referred to herein pertain to an unfinished ball as it is taken from a mold, rather than to a painted, or otherwise finished, ball.

Balls utilizing the improved configuration of dimple have provided excellent range and accuracy. It is believed that such performance is based upon boundary aerodynamics as the ball flies through the air. Boundary layer aerodynamics determine, in large part, the lift and drag forces. As turbulence in the boundary layer increases, the flow in the boundary layer becomes more energetic. The boundary layer of air stays "attached" to the ball further aft and results in production of a smaller "wake". The "wake" is responsible for a large part of the drag on the ball. The ball with less drag flies further than an equivalently struck ball, that is, has a greater "carry distance". Accordingly, the ball with the more energetic boundary layer flies further than an equivalently propelled ball having a less energetic boundary layer. The new dimple shape disclosed herein has been used on both two-piece and three-piece construction golf balls using a standard dimple pattern and has provided excellent range and accuracy.

It is to be understood that the present invention is by no means limited to the particular construction herein disclosed and/or shown in the drawings, but also comprises any modifications or equivalents within the scope of the claims.

In addition to the functional advantages provided by the above-described golf ball structure, the unique dimple configuration presents a pleasing appearance aesthetically, which aspect is the subject of U.S. patent application Ser. No. 29/004,972, filed concurrently herewith, in the name of Lauro C. Cadorniga.

Having thus described my invention, what I claim as new and desire to secure by Letters Patent of the United States is:

1. A golf ball having a plurality of dimples therein, each of said dimples comprising a major dimple portion comprising a first recess formed in a surface of said ball, a major dimple wall defining said major dimple portion, major dimple side edges formed by intersection of said major dimple wall and said surface, said major dimple portion having a major dimple largest span from one of said major dimple side edges to another of said major dimple side edges, and a minor dimple portion comprising a second recess formed in said major dimple wall, a minor dimple wall defining said minor dimple portion, said golf ball characterized by minor dimple side edges formed by intersection of said major dimple wall and said minor dimple wall, said major dimple wall and said minor dimple wall each comprising a single non-partitioned contiguous wall, said minor dimple portion having a minor dimple largest span from one of said minor dimple side edges to another of said minor dimple side edges, parallel to said major dimple span and smaller than said major dimple span, said major and minor dimple portions of each of said dimples being of similar configuration in planform and in centerline section and being similarly oriented, such that said first recess and said second recess are formed complementary to portions of first and second similar geometrical configurations of unequal size, with said minor dimple portion being substantially centered in said major dimple portion and interrupting said major dimple portion wall.

2. The golf ball in accordance with claim 1 wherein said major and minor dimple portions are of circular configuration in planform.

3. The golf ball in accordance with claim 2 wherein said major and minor dimple portion recesses are of configurations in centerline section complementary to portions of first and second spheres, respectively, said second spheres being smaller than said first spheres.

4. The golf ball in accordance with claim 3 wherein said major dimple span comprises a major chord of said major dimple portion, and said minor dimple span comprises a minor chord of said minor dimple portion, said major chord being 0.10–0.18 inch and said minor chord being 25%–75% of the length of said major chord.

5. The golf ball in accordance with claim 4 wherein said major chord is about 0.130 inch length, and said minor chord is of about 0.075 inch length.

6. The golf ball in accordance with claim 4 wherein said golf ball includes dimples having major chords of about 0.163, 0.140, 0.135 and 0.107 inch, respectively, and minor chords of about 35% of the lengths of their respective associated major chords.

7. The golf ball in accordance with claim 6 wherein said dimples are provided, respectively, with total depths of 0.0070, 0.0063, 0.0063, and 0.0049 inch, respectively.

8. The golf ball in accordance with claim 4 wherein the distance between said minor chord and a center of said minor dimple bottom wall means divided by the distance between said major chord and said minor chord is substantially constant for all of said dimples in said ball.

9. The golf ball in accordance with claim 8 wherein said constant is about 0.4.

10. The golf ball in accordance with claim 4 wherein the total depth of said major and minor dimple portions is about 0.0004–0.007 inch.

11. A golf ball having a plurality of dimples therein, each of said dimples comprising a major dimple portion comprising a first circular recess formed in a surface of said ball, a major dimple wall defining said major dimple portion, major dimple side edges formed by intersection of said major dimple wall and said surface, said major dimple portion having a major dimple largest span from one of said major dimple side edges to another of said major dimple side edges, and a minor dimple portion comprising a second circular recess formed in said major dimple wall and extending radially inwardly of said ball, a minor dimple wall defining said minor dimple portion, minor dimple side edges formed by intersection of said major dimple wall and said minor dimple wall, said minor dimple side edges forming an upstanding ridge in said dimple concentrically inwardly of said major dimple side edges, said minor dimple portion having a minor dimple largest span from one of said minor dimple side edges to another of said minor dimple side edges smaller than said major dimple span, said major and minor dimple portions of each of said dimples having recesses being of configurations in centerline section complementary to portions of first and second spheres, respectively, said second spheres being smaller than said first spheres.

* * * * *

UNITED STATES PATENT AND TRADEMARK OFFICE

CERTIFICATE OF CORRECTION

PATENT NO. : 5,470,076

DATED : Nov. 28, 1995

INVENTOR(S) : Lauro C. Cadorniga

It is certified that error appears in the above-indentified patent and that said Letters Patent is hereby corrected as shown below:

Column 2, Line 60: Delete "51 and 52" and insert -- S1 and S2 -- therefore.

Signed and Sealed this

Twenty-sixth Day of March, 1996

Bruce Lehman

*Attest:*

BRUCE LEHMAN

*Attesting Officer*

*Commissioner of Patents and Trademarks*